US005350437A

United States Patent [19]

Watanabe et al.

[11] Patent Number: 5,350,437

[45] Date of Patent: Sep. 27, 1994

[54] METHOD OF MANUFACTURING AN ALLOY POWDER WITH HARD PARTICLES DISPERSED THEREIN

[75] Inventors: Yasushi Watanabe, Chita; Hiroshi Endo, Kasugai, both of Japan

[73] Assignee: Daido Tokushuko Kabushiki Kaisha, Japan

[21] Appl. No.: 32,308

[22] Filed: Mar. 17, 1993

Related U.S. Application Data

[62] Division of Ser. No. 884,400, May 18, 1992, abandoned.

[30] Foreign Application Priority Data

May 27, 1991 [JP] Japan ..... 3-121386
Jan. 28, 1992 [JP] Japan ..... 4-13288

[51] Int. Cl.[5] ..... B22F 9/04

[52] U.S. Cl. ..... 75/346; 75/352; 75/356

[58] Field of Search ..... 75/346, 352, 354, 356, 75/357, 362

[56] References Cited

U.S. PATENT DOCUMENTS 3,740,210 6/1973 Bomford et al. ..... 75/352
4,687,511 8/1987 Paliwal et al. ..... 75/346

FOREIGN PATENT DOCUMENTS 1675061 9/1991 U.S.S.R. ..... 75/352
92-04150 3/1992 World Int. Prop. O. ..... 75/352

*Primary Examiner*—George Wyszomierski
*Attorney, Agent, or Firm*—Davis, Bujold & Streck

[57] ABSTRACT

This invention provides a minute alloy powder with hard particles uniformly dispersed therein. The alloy powder may be used as a grinder material for finishing a specular surface or surfaces of other precision instruments or as a material for cladding and strengthening a surface of a parent material by welding the alloy powder. This alloy powder is manufactured by first blending metal or alloy particle powder having a particle diameter between 0.1μ and 300μ, hard particle powder having a particle diameter between 0.1μ and 50μ, and an organic binder. The resulting material mixture is granulated into granulated powder having a particle diameter between 300μ and 80,000μ, and the powder is welded or dissolved with electric arc or plasma arc. The resulting welded bead or ingot is machined with a shaper into shavings, and the shavings are ground with a stamping mill into powder. The powder is classified such that the alloy powder having a particle diameter between 10μ and 10,000μ is sorted out. Since prior to the grinding step the powder, having a very minute particle diameter, is granulated, the time period required for the grinding step can be reduced to one third of that of the prior art.

16 Claims, 3 Drawing Sheets

METHOD OF MANUFACTURING AN ALLOY POWDER WITH HARD PARTICLES DISPERSED THEREIN

This is a divisional of copending application(s) Ser. No. 0 7/884,400 filed on May 18, 1992, now abandoned.

BACKGROUND OF THE INVENTION

This invention relates to an alloy powder having hard particles dispersed therein and a method of manufacturing the alloy powder. The alloy powder may be used as a magnetic grinder material, a material for cladding and strengthening the surface of a parent material by welding the alloy powder onto the surface (hereinafter referred to the cladding material), or for other purposes.

In known alloy powders with hard particles dispersed therein, the hard particles are dissolved and coagulated in a metal matrix.

Conventionally, when the alloy powder is manufactured, a hard particle powder and a metal particle powder are first blended to form a mixture material. The mixture material is then welded to form a welded bead on a water-cooled copper plate or other metal surface. Lastly, the welded bead is mechanically ground into powder, and the powder is classified.

The particle diameter of the mixture material to be welded is required to be regulated between 30μ (microns) and 300μ (microns), preferably between 50μ and 300μ, such that the mixture material can be appropriately supplied through air injection for a subsequent welding step. Therefore, the hard particle powder and the metal particle powder originally have a particle diameter regulated within the specified ranges. Since the hard particles carried in the welded bead also have a large diameter, it takes a long period of time to mechanically grind the welded bead because of resistance from the hard particles. Further, the hard particles, which are more brittle as compared with base metal particles, are ground prior to the base metal particles and thus, easily drop therefrom. Consequently, the hard particles are dispersed inconsistently in the manufactured alloy powder. The hard particles, even if prevented from dropping from the base metal particles, are incompletely dissolved and coagulated because of their large particle diameter, and therefore they fail to be uniformly dispersed in the alloy powder. The hard particles carried in the alloy powder are so large that they are inappropriate as the grinder material for finishing a specular surface or surfaces of other precision instruments.

SUMMARY OF THE INVENTION

An object of the invention is to provide an alloy powder, having hard particles dispersed therein, which is uniform in quality and is also fit as a grinder material for use as the finishing of a precision instrument.

Another object of the invention is to provide a method of manufacturing the alloy powder in which the time period required for the grinding step is reduced, thus reducing the entire cost for manufacturing the alloy powder.

According to the invention there is provided an alloy powder having hard particles dispersed therein comprising the hard particles having a particle diameter between 0.1μ and 50μ dispersed and carried uniformly in a base metal. The alloy powder has a particle diameter adjusted to between 10μ and 10,000μ, which is large enough to be used as the grinder material or the cladding material.

The hard particles may be selected from the group consisting of carbide, boride, silicide, oxide, nitride, or other hard substances which are available. The base metal may consist of various mono-metals or alloys which are available. The kind of hard particles and base metal, the ratio of the hard particles in the alloy powder, and other conditions are selected according to the desired application of the alloy powder having the hard particles dispersed therein. The hard particles are very minute and are uniformly dispersed in the alloy powder, thus assuring uniform properties of the alloy powder and providing a grinder material which is appropriate for finishing the specular surface or surfaces of other precision instruments.

According to the invention, there is also provided a method of manufacturing an alloy powder having hard particles dispersed therein, comprising the steps of blending a metal or an alloy particle powder having a particle diameter between 0.1μ and 300μ, hard particle powder having a particle diameter between 0.1μ and 50μ and an organic binder to form a material mixture; granulating the material mixture into granulated powder having a particle diameter suitable to be welded; welding the granulated powder to form a welded bead; mechanically grinding the welded bead into a ground powder; and classifying the ground powder.

According to the invention, there is further provided a method of manufacturing an alloy powder having hard particles dispersed therein, comprising the steps of blending a metal or an alloy particle powder having a particle diameter between 0.1μ and 300μ, hard particle powder having a particle diameter between 0.1μ and 50μ and an organic binder to form a material mixture; granulating the material mixture into granulated powder having a particle diameter suitable to be dissolved with an electric arc or plasma arc; heating and dissolving the granulated powder with the electric arc or plasma arc until a fused metal is formed among the granulated powder to accumulate and coagulate into an ingot; mechanically grinding the ingot into a ground powder; and classifying the ground powder.

In this method, prior to the step of dissolving, the granulated powder is preferably outgassed and annealed in a temperature range between 0.4 times and 1.6 times a melting temperature of the metal or alloy particle powder in a sufficient flow of hydrogen or inert gas or in a vacuum.

Although the hard particle powder has a minute particle diameter, it is blended with the organic binder and the metal or alloy particle powder to form a material mixture. The material mixture, having an appropriately large particle diameter, is granulated such that the granulated powder can be easily supplied to the subsequent step of welding or dissolving through air injection. Therefore, the granulated powder can be welded or dissolved with an electric arc or plasma arc effectively. Since the steps of blending and granulating precede the air injection, the hard particles can be kept uniformly mixed in the base metal during the air injection. Consequently, the hard particles are uniformly dispersed in the welded bead or the ingot. When the welded bead or the ingot is ground with a stamping mill or other mechanical means, the very minute and uniformly dispersed hard particles cause little resistance, thus facilitating the grinding step. The particle diameter of the granulated powder suitable for the welding step is generally between 30μ and 300μ, while the particle diameter suitable for the dissolving step with an electric arc or plasma arc is generally between 300μ and 80,000μ. This particle diameter may deviate from these specified ranges, as long as it causes no problems when the granulated powder is supplied through the air injection. A 3% polyvinyl alcohol solution or other substance can be used as the organic binder.

The maximum particle diameter of the hard particle powder can be 50μ for the following reason.

The particle diameter of the powder, which can be supplied to the subsequent welding step through air injection, varies between 30μ and about 300μ. If the powder, having a particle diameter of about 300μ, is granulated from the hard particle powder having a particle diameter of 50μ, no problems occur during the air injection. Further, the hard particles having a particle diameter of about 50μ can be dispersed uniformly in the alloy powder having a particle diameter between 10μ and 10,000μ.

When, at the welding step or the dissolving step, the granulated powder is sintered, or dissolved and crystallized, its particle diameter becomes enlarged. Therefore, the particle diameter of the hard particle powder is preferably between 0.1μ and 10μ.

In the method, prior to the step of grinding, the welded bead or the ingot is preferably stored at a temperature between 0.4 times and 1.6 times the melting temperature of the base metal or alloy, for a specified period of time, and then cooled, thus facilitating the subsequent grinding step. The maximum storing temperature can be 1.6 times the melting temperature of the base metal or alloy because the dissolution of the hard particle powder increases the melting temperature of the base metal or alloy and keeps the welded bead or the ingot from melting even if heated at a temperature higher than the melting temperature.

In the method, prior to the step of grinding the welded bead or the ingot with the stamping mill or other appropriate means, the welded bead or the ingot is machined with a shaper into shavings. Therefore, the time period required for operating the stamping mill or other appropriate grinding machine can be reduced.

At the final step of classifying, the particle diameter of the ground powder is adjusted to between 10μ and 10,000μ, thus providing an alloy powder having hard particles dispersed therein with a particle diameter between 10μ and 10,000μ.

DETAILED DESCRIPTION OF PREFERRED EMBODIMENTS

Figure 4A:
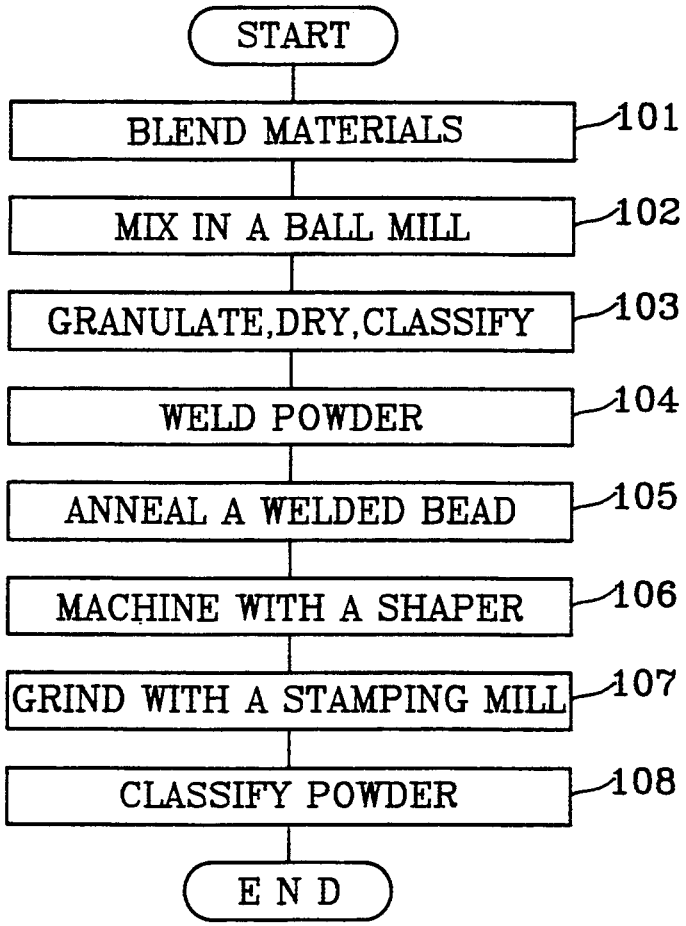
FIG. 4A is a flow chart of the manufacturing steps of the first and second embodiments.

As shown in FIG. 4A, a method of a first embodiment for manufacturing alloy powder with hard particles dispersed therein comprises the step of blending materials 101. The materials consisting of the hard particle powder and metal or alloy particle powder (hereinafter referred to as the metal particle powder) are selected according to the usage of the alloy powder. The hard particle powder having a particle diameter between 0.1μ and 50μ and the metal particle powder having a diameter between 0.1μ and 300μ are blended, and an organic binder is added to the material mixture. Subsequently, at step 102, the material mixture is mixed in a ball mill to prepare a uniformly mixed powder.

Subsequently, at step 103, the powder mixture is granulated and dried with a granulating dryer, and classified with a classifier, such that powder having a particle diameter between 30μ and 300μ is sorted out. This particle diameter is suitable for a subsequent step 104 of welding, where the powder is welded with plasma, and a welded bead is formed on a water-cooled copper plate.

Subsequently, at the optional step 105 of annealing, the welded bead is stored at the temperature 0.4 to 1.6 times a melting temperature of the base metal for a specified period of time and air-cooled. This step 105 can be omitted, if desired.

Subsequently, at step 108, the welded bead is machined with a shaper into shavings. At step 107, the shavings are ground with the stamping mill, and at step 108, the resulting alloy powder with hard particles dispersed therein is classified with a vibrating classifier such that the alloy powder having a particle diameter between 10μ and 10,000μ is sorted out.

In an example for comparison, hard particle powder and metal particle powder, which have particle diameters between 30μ and 300μ, appropriate for air injection, are blended. This material mixture is formed into a welded bead by welding the powder with plasma. The welded bead is subsequently machined with a shaper into shavings. These shavings are then ground with a stamping mill and the ground powder is classified, thus sorting out the portion of the alloy powder having a particle diameter of 10,000μ or less.

First, second and third embodiments, and the example for comparison, are now explained and compared in detail.

First Embodiment

At step 101, 500 g of nickel powder from its carbonyl, having a particle diameter between 1μ and 3μ, and 500 g of niobium carbide powder, having a particle diameter between 1μ and 3μ, were blended, and 1,000 cc of 3% polyvinyl alcohol solution was added to form a material mixture.

Subsequently, at step 102 the material mixture was mixed in a ball mill at a speed of 30 r.p.m. for 20 hours. The ball mill comprises a cylindrical body with a diameter of 30 cm and a height of 400 cm and has therein a resin-clad steel ball having a weight of 200 g and a diameter of 15 mm.

At step 103, the powder mixture was taken out of the ball mill, granulated and dried with a universal agitator. The granulated powder was then classified such that powder filtered through 60 meshes maximum and 350 meshes minimum filters, therefore the powder having a particle diameter between about 40μ and about 250μ was sorted out. In this embodiment, the universal agitator, with a capacity of 2 kg, was operated under a revolution speed of 63 r.p.m. and a self-rotation speed of 43 r.p.m. at a temperature of 50° C. for five hours.

Subsequently, at step 104, the granulated and dried powder was formed into a pig-shaped welded bead having a weight of 500 g by plasma powder welding, under the conditions that: an electrical current for the welding was 150A; the powder supply speed was 20 g/min.; the supply amount of plasma gas was 3 liters/min.; and the supply amount of shielding gas was 10 liters/min.

At step 105 of annealing, the welded bead was heated and stored at 1,000° C. for one hour, and then, air-cooled at room temperature.

Subsequently, at step 106, the welded and annealed bead was machined with a shaper into shavings. At step 107, the shavings were ground mechanically with a stamping mill. In the first embodiment the machining of 500 g of the welded bead required 30 hours, and the grinding of 500 g of the shavings required 20 hours.

Second Embodiment

This embodiment is identical to the first embodiment, except that the step 105 of annealing was omitted. In the second embodiment, the machining of 500 g of the welded bead required 40 hours, and the grinding of 500 g of the shavings required 25 hours.

Example For Comparison

First, 500 g of gas-atomized nickel powder was filtered through 80 meshes maximum and 250 meshes minimum filters, therefore having a particle diameter between about 60μ and 180μ. 500 g of niobium carbide powder having the same particle size was then blended with the nickel powder. Subsequently, the powder mixture was formed into 500 g of a pig-shaped welded bead through plasma powder welding under the same conditions as those of the first and second embodiments. Specifically, an electrical current for the welding was 150A, the powder supply speed was 20 g/min., the supply amount of plasma gas was 3 liters/min., and the supply amount of shielding gas was 10 liters/min.

In this example, the machining of 500 g of the welded bead required 30 hours, and the grinding of 500 g of the shavings required 100 hours.

Consequently, in the first and second embodiments, the time period required for the grinding step can be reduced to one third of that in the example for comparison.

Further, in the first embodiment, the time period required for the machining and grinding is shorter than that in the second embodiment, because the first embodiment incorporates an annealing step 105 for the welded bead.

Figure 1:
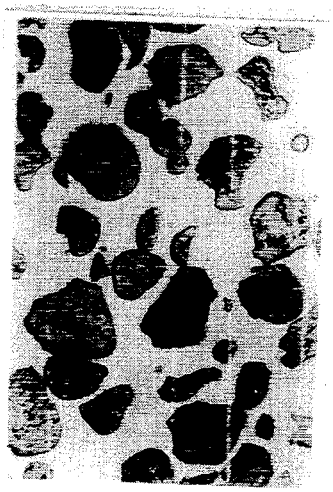
FIG. 1 is a picture showing a 100 times enlarged the micro-texture of a prior art alloy powder with hard particles dispersed therein as an example for comparison with the present invention.
Figure 2:
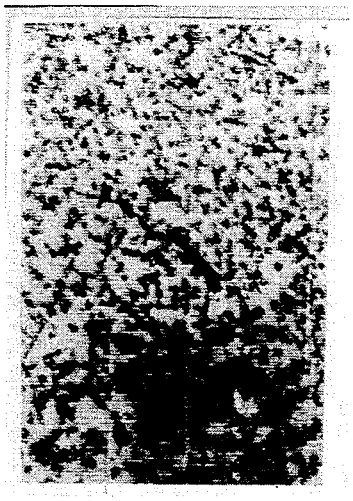
FIG. 2 is a picture showing a 100 times enlarged the micro-texture of an alloy powder with hard particles dispersed therein as in the first and second embodiments according to the present invention.

As shown in FIG. 2, in the alloy powder with hard particles dispersed therein resulting from the first and second embodiments, niobium carbide particles have uniform properties and are uniformly dispersed in the nickel base metal. Whereas, in the example for comparison as shown in FIG. 1, niobium carbide particles are coarsely dispersed in some areas and densely dispersed in other areas. Further, the niobium carbide particles in the first and second embodiments are more minute and more suitable for finishing a specular face or the surface of a precise instrument as compared with those in the example for comparison. When the alloy powder with hard particles dispersed therein of the first and second embodiments is used as the cladding material, the very minute niobium carbide are particles are uniformly dispersed in a layer raised on the surface of the parent material. Therefore, the layer, which is uniform in properties and has little welding defects, suitably strengthens the surface of the parent material.

Third Embodiment

Figure 4B:
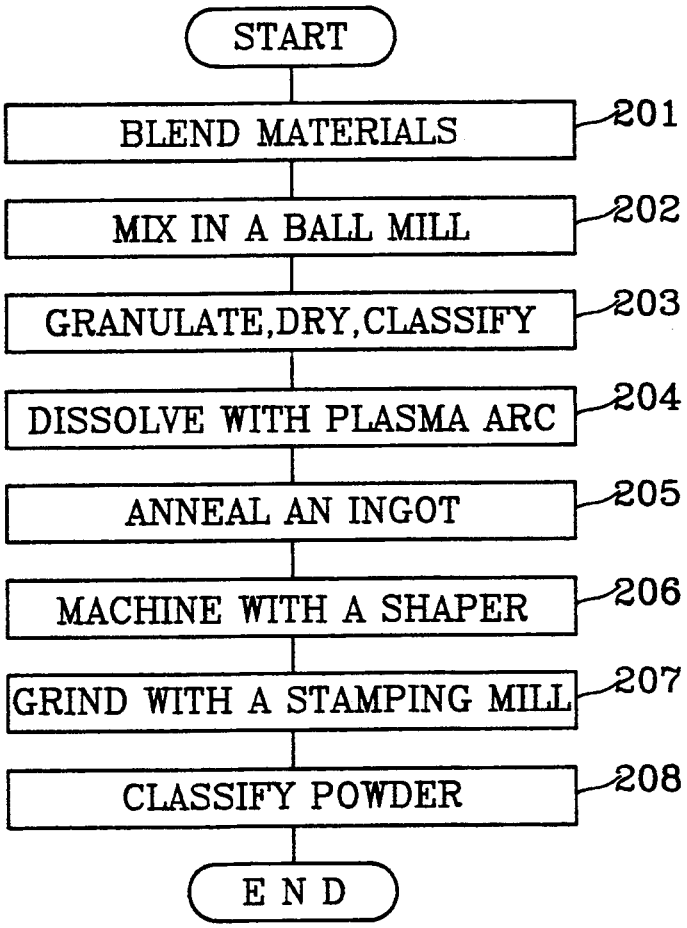
FIG. 4B is a flow chart of the manufacturing steps of the third embodiment.

As shown in the flow chart of FIG. 4B, the third embodiment is different from the first and second embodiments in that step 204, of dissolving with a plasma arc, replaces welding step 104. The other steps 201, 202, 203, 205, 206, 207 and 208 correspond to steps 101, 102, 103, 105, 106, 107 and 108, respectively. At step 204 in the third embodiment an ingot results, whereas at step 104 a welded bead results.

At step 201, 2.1 kg of carbonyl iron powder, having a particle diameter between 1μ and 3μ, and 3.9 kg of niobium carbide powder, having a particle diameter between 1μ and 3μ, were blended, and 2,000 cc of 3% polyvinyl alcohol solution was added to this material mixture. At step 202, the material mixture was mixed in a ball mill under the same conditions as those for the first and second embodiments. In the third embodiment, the amount of the material mixture was so large that the step of mixing in the ball mill was conducted in six batches.

At step 203, the powder mixture was taken out of the ball mill, granulated, dried and classified under the same conditions as those for the first and second embodiments. In the third embodiment, the step of granulating, drying and classifying were conducted in three batches.

Figure 3:
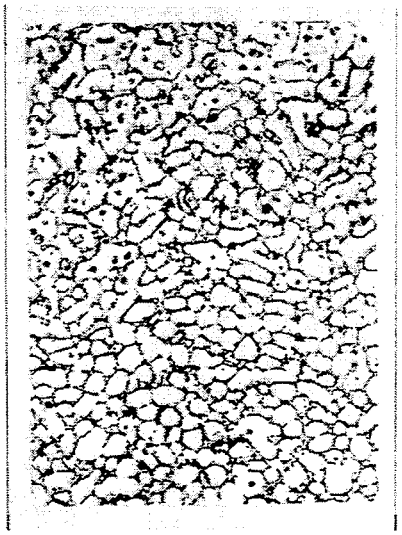
FIG. 3 is a picture showing a 100 times enlarged the micro-texture of an ingot as an intermediate product resulting from a third embodiment according to the present invention.

Subsequently, at step 204, the granulated and dried powder, having a particle diameter between about 1,000μ and about 8,000μ, was formed into a 5 kg ingot through plasma arc dissolving under the conditions that: an electrical current for the dissolving was 1200A; three units of torch having a plasma gas supply amount of 80 liters/min. were used; and the powder supply speed was 400 g/min. As shown in FIG. 3, hard particles are dispersed uniformly in the ingot.

At step 205 of annealing, the ingot was heated and stored at a temperature of 1,000° C. for one hour, and air-cooled in the atmosphere.

At step 206, the ingot was machined with a shaper into shavings. At step 207, the shavings were ground mechanically with a stamping mill, and at step 208, the ground powder was classified.

In the third embodiment, the machining of 5 kg of the ingot required 15 hours, and 5 kg of the shavings were ground with the stamping mill in ten batches. Each of the 500 g batches of shavings were ground, requiring 20 hours.

As aforementioned, in the third embodiment, the shavings were ground with the stamping mill over a shorter time period as compared with the example for comparison.

From the above description of a preferred embodiment of the invention, those skilled in the art will perceive improvements, changes, and modifications. Such improvements, changes and modifications within the skill of the art are intended to be covered by the appended claims. For example, in the embodiments, carbide was used as a hard particle powder, but nitride, boride or other compounds can also be used. In the embodiments, the ratio of the hard particle powder to the metal particle powder was 50:50. However, the ratio can be adjusted according to the usage of the final product of the alloy powder with hard particles dispersed therein. The method of the welding or dissolving step is not limited to a plasma arc method.

What is claimed is:

1. A method for manufacturing an alloy powder having hard particles dispersed therein, said method comprising the steps of:

blending one of a metal base material and a metal alloy base material, having a particle diameter between about 0.1 microns and 300 microns; a hard particle powder selected from the group consisting of metal borides, carbides, silicides, oxides, nitrides or mixture thereof, having a particle diameter between about 0.1 microns and 50 microns; and an organic binder to form a material mixture;

granulating said material mixture of particles and binder into a granulated powder having a particle diameter suitable for forming a metal and particle containing bead when heated;

heating said granulated powder to a sufficient temperature and for a sufficient period of time to form a welded bead;

mechanically grinding said welded bead into a ground powder; and classifying said ground powder.

2. A method for manufacturing an alloy powder according to claim 1, further comprising the step of:

prior to the step of mechanically grinding said welded bead, storing said welded bead at a temperature between about 0.4 and 1.6 times the melting temperature of said base material for a period of time sufficient to soften the welded bead; and cooling said welded bead.

3. A method for manufacturing an alloy powder according to claim 2, further comprising the step of:

machining said welded bead with a shaper into shavings, prior to the step of mechanically grinding said welded bead and after the step of storing.

4. A method for manufacturing an alloy powder according to claim 2, wherein said classifying step comprises:

sorting said ground powder to particle diameters of between about 10 microns and 10,000 microns.

5. A method for manufacturing an alloy powder according to claim 4, wherein said classifying steps comprises:

sorting said ground powder to particle diameters of between about 10 microns and 10,000 microns.

6. A method for manufacturing an alloy powder according to claim 1, further comprising the step of:

prior to the step of mechanically grinding said welded bead, machining said welded bead with a shaper into shavings.

7. A method for manufacturing an alloy powder according to claim 6, wherein said classifying step comprises:

sorting said ground powder to particle diameters of between about 10 microns and 10,000 microns.

8. A method for manufacturing an alloy powder according to claim 1, wherein said classifying step comprises sorting said ground powder to particle diameters of between about 10 microns and 10,000 microns.

9. A method for manufacturing an alloy powder having hard particles dispersed therein, said method comprising the steps of:

blending one of a metal base material and a metal alloy base material, having a particle diameter between about 0.1 microns and 300 microns; a hard particle powder selected from the group consisting of metal borides, carbides, silicides, oxides, nitrides or mixtures thereof, having a particle diameter between about 0.1 microns and 50 microns; and an organic binder to form a material mixture;

granulating said material mixture into a granulated powder having a particle diameter suitable to be dissolved with one of an electric arc and a plasma arc;

heating and dissolving said granulated powder with one of said electric arc and said plasma arc until said granulated powder is formed into a fused metal which accumulates and coagulates into an ingot;

mechanically grinding said ingot into a ground powder; and classifying said ground powder.

10. A method for manufacturing an alloy powder according to claim 9, further comprising the step of:

prior to heating and dissolving said granulated powder, outgassing and annealing said granulated powder at a temperature between about 0.4 and 1.6 times the melting temperature of said base material in one of a flow of hydrogen, a flow of inert gas and a vacuum.

11. A method for manufacturing an alloy powder according to claim 10, further comprising the step of:

prior to the step of mechanically grinding said ingot, storing said ingot at a temperature between about 0.4 and 1.6 times the melting temperature of said base material for a period of time sufficient to soften the ingot; and cooling said ingot.

12. A method for manufacturing an alloy powder according to claim 10, further comprising the step of:

prior to the step of mechanically grinding said ingot, machining said ingot with a shaper into shavings.

13. A method for manufacturing an alloy powder according to claim 9, further comprising the step of:

prior to the step of mechanically grinding said ingot, storing said ingot at a temperature between about 0.4 and 1.6 times the melting temperature of said base material for a period of time sufficient to soften the ingot; and cooling said ingot.

14. A method for manufacturing an alloy powder according to claim 13, further comprising the step of:

machining said ingot with a shaper into shavings, prior to the step of mechanically grinding said ingot and after the step of storing said ingot.

15. A method for manufacturing an alloy powder according to claim 9, further comprising the step of:

prior to the step of mechanically grinding said ingot, machining said ingot with a shaper into shavings.

16. A method for manufacturing an alloy powder according to claim 9, wherein said classifying step comprises:

sorting said ground powder to particle diameters of between about 10 microns and 10,000 microns.

* * * * *